United States Patent [19]

Bernauer et al.

[11] Patent Number: 4,973,227

[45] Date of Patent: Nov. 27, 1990

[54] METHOD OF PRODUCING A VACUUM

[75] Inventors: Otto Bernauer, Moers; Clemens Halene, Düsseldorf; Manfred Keller, Krefeld, all of Fed. Rep. of Germany

[73] Assignee: HWT Gesellschaft für Hydrid-und Wasserstofftechnik m.b.H., Mülheim/Ruhr, Fed. Rep. of Germany

[21] Appl. No.: 367,025

[22] Filed: Jun. 16, 1989

[51] Int. Cl.[5] ..... F04B 37/02

[52] U.S. Cl. ..... 417/51; 417/53; 252/181.6; 423/248; 423/644

[58] Field of Search ..... 417/48, 51, 53, DIG. 1; 252/181.2, 181.6; 423/248, 644

[56] References Cited

U.S. PATENT DOCUMENTS

| | | | |
|---|---|---|---|
| 2,668,253 | 2/1954 | Taylor | 417/48 X |
| 4,160,014 | 7/1979 | Gamo et al. | 423/644 |
| 4,278,466 | 7/1981 | de Pous | 423/644 X |
| 4,283,226 | 8/1981 | Van Mal et al. | 423/644 X |
| 4,446,101 | 5/1984 | Bernauer et al. | 420/424 |
| 4,717,551 | 1/1988 | Bernauer et al. | 252/181.6 X |
| 4,907,948 | 3/1990 | Barosi et al. | 417/48 X |

FOREIGN PATENT DOCUMENTS

| | | | |
|---|---|---|---|
| 3436754 | 8/1985 | Fed. Rep. of Germany . | |
| 755804 | 8/1956 | United Kingdom | 252/181.6 |

*Primary Examiner*—Michael Koczo
*Assistant Examiner*—Eugene L. Szczecina, Jr.
*Attorney, Agent, or Firm*—Cohen, Pontani & Lieberman

[57] ABSTRACT

A method of producing a vacuum in a volume of a hollow body which has at least one outlet opening for the gaseous atmosphere present therein, the method includes the following steps: introducing at least about 3 g/dm$^3$ of evacuation volume of a metal hydride into the hollow body so as to take up less than about 5% of the volume 3. The metal hydride comprises a hydride forming alloy of the formula $$Ti(V_{1-a-b}\,Fe_aAl_b)_{xy}Mn_z,$$

wherein $1<x\leqq 2$
$0<y\leqq 0.2$
$x+y\leqq 2$
$0<a\leqq 0.4$
$0<b\leqq 0.2$
$a+b\leqq 0.5$
$(1-a-b)\ x\geqq 1$
$0<z\leqq 2-x-y.$ The metal hydride is heated to a temperature so that a substantial amount of the gaseous hydrogen is released from the hydride, the heating step is performed so that heating of the hollow body will not exceed a temperature of about 500° C.; flushing the volume with the gaseous hydrogen released from the hydride thereby replacing said gaseous atmosphere present in the volume prior to the release thereof; closing the outlet of the hollow body; cooling the hollowing body; and absorbing the gaseous hydrogen with the hydride forming alloy.

22 Claims, 1 Drawing Sheet

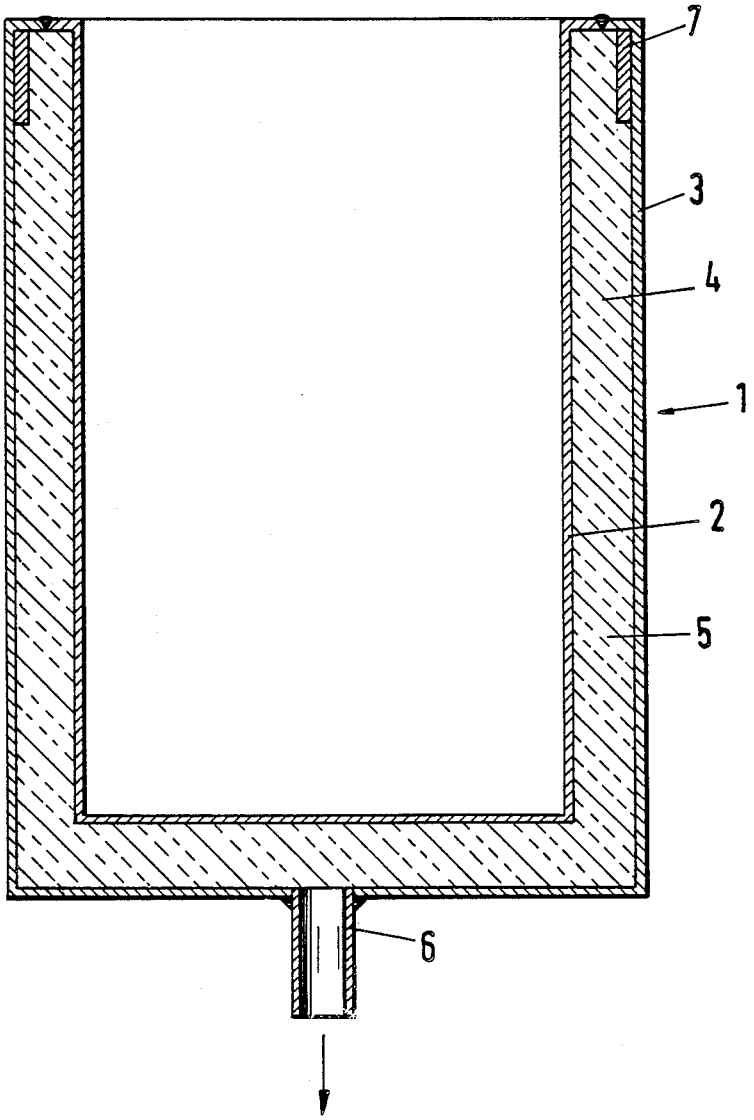
7
3
4
1
2
5
6

METHOD OF PRODUCING A VACUUM

FIELD OF THE INVENTION

The present invention relates to a method of producing a vacuum in a hollow body by utilizing a metal hydride, and particularly to a method utilizing as the metal hydride a hydride forming alloy containing Ti-V-Fe-Al-Mn.

BACKGROUND OF THE INVENTION

The evacuation of hollow spaces is required in many technical applications, for instance in the case of electric tubes, liquified gas pipelines and so-called vacuum insulations. The gaseous atmosphere present in the hollow space to be evacuated is drawn off by means of a vacuum pump which, depending on the required value of the vacuum to be applied, operates in accordance with different principles, for instance, such as a liquid jet pump, reciprocating pump, centrifugal pump. The required pumping time not only depends on the efficiency and the volume of the evacuation space but it is also strongly influenced by the geometry of the evacuation space and increases disproportionately the lower the pressure stage of the vacuum to be obtained. It is customary to heat the subject hollow body during the evacuation to temperatures of, for instance, 300° C. in order also to remove during the evacuation the molecular water layers or gas layers adhering to the inner walls of the evacuation space or to solids which were introduced into the evacuation space for instance, such as a heat-insulating material.

For the dependable maintaining of a high vacuum for a lengthy period of time, such as several years, it is furthermore known to introduce so-called getter materials into the evacuated hollow space. These getter materials are solids and have the property of absorbing gases which are subsequently liberated within the evacuation space or penetrate into the space from the outside. One known agent for the purpose is activated charcoal. It is furthermore known from Federal Republic of Germany Patent No. 34 36 754 to use metal hydrides having a base of Ti-V-Fe-Al-Cr-Mn as getter material for maintaining a vacuum within the vacuum jacket of thermal insulating containers.

The vacuum is produced in this case by pumping. The quantity of metal hydride introduced into the evacuation space amounts to 2–4 g/dm$^3$ of vacuum space.

In order to obtain the outstanding heat-insulating properties of vacuum insulation it is necessary to assure a high vacuum on the order of at least $10^{-3}$ to $10^{-4}$ mbar. The walls of a suitable insulating jacket are, as a rule, made of metallic materials, in particular of alloy steel. In order to enable a mutual supporting of the inner and outer walls of the insulating jacket and to minimize the heat losses due to heat radiation, the hollow space is frequently filled with porous insulating material, for instance, kieselguhr or fibrous insulating material such, for instance, as glass fibers. Although the addition of such materials reduces the volume of the gases which are to be removed from the hollow space during the evacuation, the pumping times for obtaining an equally good vacuum are greatly increased as compared with the time required for a corresponding empty vacuum space due to the large number of minute hollow spaces, for instance, pores formed by the heat-insulating material. While, for instance, for an "empty" vacuum space a pumping time of 30 to 60 minutes was required for a vacuum of $10^{-3}$ mbar, the pumping time for the corresponding "filled" vacuum space amounted to about 12 hours. In this way, however, orders of magnitude are reached which constitute an obstacle to the manufacture of corresponding heat-insulating elements in large series, not to mention mass production.

One method of evacuating electrical vacuum discharge is known from Federal Republic of Germany Unexamined Application for Patent No. 15 39 126, in which the removal of the gaseous atmosphere from the evacuation space takes place without pumping. The housing of the device to be evacuated is for this purpose inserted into a hydrogen furnace and heated at 450°–500° C. while continuously flushing with hydrogen, so as to remove all foreign gases and adherent impurities, which decompose into gases under the action of the temperature.

Before starting the heating, an evacuated capsule is inserted into the housing, the capsule being substantially filled with titanium powder. After sufficient flushing with hydrogen, the flushing openings present in the housing are hermetically sealed and the housing is cooled. By a device which can be actuated from the outside, the capsule containing the titanium is thereupon punctured so that the hydrogen contained in the housing has access to the titanium powder. Due to its hydride-forming property, the titanium avidly absorbs the gaseous hydrogen so that a vacuum is produced inside the housing. Due to the use of a capsule for the hermetic enclosing of the hydride-forming titanium and due to the required puncturing mechanism as well as due to the need for a special furnace with a hydrogen atmosphere, this method is very cumbersome and even dangerous (danger of explosion) and therefore poorly suited for large-scale manufacture.

For the preparation of the capsule a similar procedure is described in Federal Republic of Germany Unexamined Application for Patent No. 15 39 126, which also uses a hydrogen furnace. Into the capsule which is provided with a series of openings for the passage of the gas there is introduced, on a sieve-like intermediate level, a quantity of powdered titanium hydride which fills about half the volume of the capsule. The capsule is then inserted into the hydrogen-flushed furnace and heated to more than 700° C. so that the hydrogen bound in the titanium hydride is practically completely liberated. Together with the hydrogen of the furnace atmosphere, the liberated hydrogen causes a thorough flushing of the inside of the capsule and the displacement of all foreign gas components. A further increase in temperature to about 1000° C. leads to the incipient melting of hard solder disks which are arranged in the immediate vicinity of the flushing openings so that all flushing openings are hermetically sealed after the cooling of the capsule.

The enclosed hydrogen atmosphere is avidly absorbed by the titanium powder so that a vacuum is produced. However, this vacuum does not have any immediate function with respect to the subsequent use of the capsule for the evacuation of electrical apparatus, but serves merely to preserve the absorption capacity of the titanium powder. The vacuum within the capsule is thus merely an incidental or so-called "auxiliary vacuum" and not a "useful vacuum" actually to be produced in a comparatively much more voluminous hollow body. Also, due to the high heating temperatures required, this method is considered unsuitable for most applications for the evacuation of large hollow spaces since the materials of the walls of the hollow space would frequently change their properties in impermissible manner at such temperatures.

SUMMARY OF THE INVENTION

It is therefore an object of the present invention to provide a method by which a rapid evacuation of hollow spaces is made possible in a manner which is as simple and economical as possible; the method is suitable, in particular, for rapidly producing a high vacuum even in "filled" evacuation spaces and does not lead to impairments of the properties of the material due to excessive heating.

This objection is achieved in accordance with the invention by a method of producing a vacuum in a volume of a hollow body having at least one outlet opening for the gaseous atmosphere present therein, said method comprising the following steps:

introducing at least about 3 g/dm$^3$ of evacuation volume of a metal hydride into said hollow body so as to take up less than about 5% of said volume, said metal hydride comprising a hydride forming alloy of the formula $$Ti(V_{1-a-b}Fe_aAl_b)_{xy}Mn_z,$$

wherein $1<x\leqq 2$
$0<y\leqq 0.2$
$x+y\leqq 2$
$0<a\leqq 0.4$
$0<b\leqq 0.2$
$a+b\leqq 0.5$
$(1-a-b)x\geqq 1$
$0<z\leqq 2-x-y;$ heating said metal hydride to a temperature so that a substantial amount of said gaseous hydrogen is released from said hydride, said heating step being performed so that heating of said hollow body will not exceed a temperature of about 500° C.;

flushing said volume with said gaseous hydrogen released from said hydride thereby replacing said gaseous atmosphere present in said volume prior to said release:

hermetically closing said outlet;

cooling said hollow body; and absorbing said gaseous hydrogen by said hydride forming alloy.

Preferably, the metal hydride exhibits a maximum discharge of hydrogen against ambient pressure at a temperature which lies at least about 200°-300° K. above the normal operating temperature of the hollow body.

The following are preferred steps performed in the method of the present invention. The metal hydride is introduced into the hollow body at one or more places which is/are as far away as possible from the outlet opening of the hollow body. Towards the end of the flushing phase it is preferred to separately heat the metal hydride to a temperature which is higher than the temperature at which the hydrogen has been previously released. As will be described below, the method of producing a vacuum may be assisted by the application of an additional vacuum created by a vacuum pump connected to the hollow body for removing at least a part of the gaseous atmosphere contained therein. This step is preferably performed at least after the metal hydride is heated. Preferably, during the flushing phase the outlet opening of the hollow body is at the lowest possible level with respect to the other parts of the hollow body for assisting the removal of the gaseous atmosphere previously present in the hollow body. Finally, it is preferred that the metal hydride introduced into the volume of the hollow body is limited to an amount of less than about 3% of the original evacuation volume.

The basic concept of the invention resides in the fact that a metal hydride, which is already known as getter material, is used, in addition to its function of maintaining a vacuum, also already for the production of said vacuum. It is necessary for this purpose to introduce the metal hydride in comparatively large amount into the evacuation space.

The amount however is limited in the manner that at most 5%, and preferably less than 3%, of the original evacuation volume is filled by the metal hydride. During the heating of the evacuation space, the hydrogen-charged metal hydride liberates gaseous hydrogen in such substantial quantities (at normal pressure at least 3 to 10 times the evacuation volume) that a flushing of the evacuation space is brought about, i.e., the originally existing gaseous atmosphere is completely displaced by the hydrogen gas released from the metal hydride. The better the pre-treatment of the evacuation space and of the fillers (for instance, heat insulators) possibly introduced therein with respect to the removal of impurities, the less hydride material is required. During the flushing several properties of the hydrogen gas have a very positive effect:

Due to its molecular size, the hydrogen gas will penetrate very rapidly into the smallest hollow spaces of a heat-insulating material and displace other gases therefrom.

Due to its low specific gravity, a targeted displacement effect results in the case of the outlet opening being arranged at the bottom of the container since the other gases present are of a higher specific gravity and will therefore flow downward and out.

Due to its reducing action, removal of surface adsorption layers as well as certain absorption layers in the evacuation space is facilitated.

In accordance with the invention, the heating of the evacuation space is limited to about 400° C. to at most about 500° C., so that the material will not be damaged. The heating in this connection is preferably carried out in such a manner that at least the metal hydride (possibly by separate heating) is particularly strongly heated in the final phase. It is preferred when the stored hydrogen gas is substantially liberated from the metal hydride.

This way, a particularly good absorption capacity is obtained after the closing of the evacuation space. The vacuum is established in the evacuation space due to the fact that, upon the cooling of the dehydrogenated hydride-former, the hydrogen gas atmosphere which is still present is completely absorbed therein. In order that the discharge pressure of the metal hydride lies, at the maximum operating temperatures to which the evacuation space will be subsequently exposed, under all circumstances below the pressure stage of the required vacuum, the metal hydride used must have a corresponding storage characteristic (pressure-temperature curve) and is brought to a correspondingly predetermined high temperature in the heating-out phase. The alloy for the metal hydride should be suitably selected so that maximum liberation of the stored hydrogen takes place only at a temperature which lies at least about 200°-300° K. above the normal subsequent operating temperature of the hollow body.

It is, of course, possible to carry out part of the evacuation work to be performed in known manner by pumping and thus to employ a combination of the method of the invention with the method of the prior art. In this case the pumping takes place in the final phase of the heating process. In this way, evacuations down to continuous, very low end pressure stages can be achieved.

The method of the invention can be applied particularly advantageously to the evacuation of hollow spaces which are filled with porous or fibrous materials such, for instance, as vacuum-superinsulations or of spaces which have an extensive and ramified spatial structure such, for instance, as a branched pipeline system. In the latter case, a correspondingly dimensioned quantity of the hydride material is introduced into each individual system of the total system and used for the displacement of the existing gaseous atmosphere.

BRIEF DESCRIPTION OF THE DRAWING

The method will be described in detail below with reference to the accompanying figure which shows an embodiment of a hollow space to be evacuated in accordance with the present invention.

DETAILED DESCRIPTION OF A PRESENTLY PREFERRED EMBODIMENT

The figure shows, in longitudinal axial section, a heat-insulating container 1 (without cover) which has an inner alloy steel shell 2 and an outer alloy steel shell 3. The hollow space 4 formed between the two shells 2 and 3 is provided with a filling of fiberglass material 5. The latter supports the inner shell 2 with respect to the outer shell 3 and results in a reduction of radiation. In order for the container 1 to reach the high value of a vacuum-superinsulation, the pressure in the hollow space 4 must be reduced to a value of less than $10^{-3}$ mbar. A gas outlet connection 6 is inserted into the outer shell 3. A quantity of about 20-30 grams of metal hydride 7 per $dm^3$ of the hollow space 4 has been introduced at places which are as far as possible away from the outlet connection 6. The metal hydride 7 is selected so that its hydrogen charge lies between about 2 to about 3% by weight of the stored mass at room temperature and normal ambient pressure. For the application of the vacuum, the container 1 is heated, for instance in a normal heating furnace, to above 200° C. and preferably to about 450°-500° C. With increasing heating of the metal hydride 7, the hydrogen gas is liberated into the hollow space 4, penetrates into the finest cavities of the fiberglass filling 5 and displaces, for instance against the normal ambient pressure, the original gaseous atmosphere of higher specific gravity essentially completely through the outlet connection 6 located at the bottom of the container. In this connection, the hydrogen gas which was liberated in the initial phase at relatively high pressure and the total quantity of which (at normal pressure) amounts to about 10 times the volume of the hollow space 4, effects in any event an intensive flushing of the hollow space 4. In order to bring about the greatest possible discharge (for instance, more than 95%) of hydrogen gas from the metal hydride, it is preferable to increase the temperature of the metal hydride 7 to about 500° C. in the final phase of the heating by a locally concentrated addition of heat.

This increase in temperature may possibly even amount to more than 500° C. without also heating the walls of the hollow body to the same extent if, for instance, electric-resistance heating is carried out directly on the metal hydride for the local heating.

As soon as the flow of gas through the outlet connection 6 has dropped to a pre-determined minimum value, the mouth of the outlet connection is hermetically sealed and the container 1 is cooled. With increased cooling of the metal hydride 7, the latter absorbs the hydrogen gas present in the hollow space 4. At a temperature of the metal hydride 7 of about 200° C., which corresponds, for instance, to the subsequent maximum operating temperature of the container 1, the hydrogen discharge pressure of the metal hydride 7, and thus the vacuum obtained, amounts to less than $10^{-4}$ mbar. At room temperature a value less than $10^{-5}$ mbar is even reached. This vacuum can be even further improved by effecting in addition to the hydrogen gas flushing, a final reduction in the quantity of hydrogen gas by means of a vacuum pump. The vacuum stage, at room temperature, obtainable in this manner is between $10^{-8}$ to $10^{-9}$ mbar.

Since these as well as further embodiments and modifications thereto are intended to be within the scope of the present invention, the above description should be construed as illustrative and not in a limiting sense, the scope of the invention being defined solely by the following claims.

What is claimed is:

1. A method of producing a vacuum in a volume of a hollow body having at least one outlet opening for the gaseous atmosphere present therein, said method comprising the following steps:

introducing at least about 3 $g/dm^3$ of evacuation volume of a metal hydride into said hollow body so as to take up less than about 5% of said volume, said metal hydride comprising a hydride forming alloy of the formula $$Ti(V_{1-a-b}Fe_aAl_b)_{xy}Mn_z,$$

wherein $1<x\leqq 2$
$0<y\leqq 0.2$
$x+y\leqq 2$
$0<a\leqq 0.4$
$0<b\leqq 0.2$
$a+b\leqq 0.5$
$(1-a-b)x\geqq 1$
$0<z\leqq 2-x-y;$ heating said metal hydride to a temperature so that a substantial amount of said gaseous hydrogen is released from said hydride, said heating step being performed so that heating of said hollow body will not exceed a temperature of about 500° C.;

flushing said volume with said gaseous hydrogen released from said hydride thereby replacing said gaseous atmosphere present in said volume prior to said release;

hermetically closing said outlet;

cooling said hollow body; and absorbing said gaseous hydrogen by said hydride forming alloy.

2. The method according to claim 1, wherein said metal hydride exhibits the maximum discharge of hydrogen against ambient pressure at a temperature which lies at least about 200°-300° K. above the normal operating temperature of said hollow body.

3. The method according to claim 1, wherein said metal hydride is introduced into said hollow body at a location which is as far away as possible from said outlet opening.

4. The method according to claim 1, additionally comprising the step of separately heating said metal hydride towards the end of said flushing phase to a temperature which is higher than said temperature at which said hydrogen has been previously released.

5. The method according to claim 1, additionally comprising the step of operatively connecting a vacuum pump to said hollow body and assisting the removal of a part of said gaseous atmosphere contained in said hollow body at least after said heating of said metal hydride.

6. The method according to claim 1, wherein during said flushing phase said outlet opening is at the lowest level with respect to the remainder of said hollow body.

7. The method accordance to claim 1, whereby the quantity of said metal hydride introduced into said volume is limited to taking up less than about 3% of said evacuation volume.

8. The method according to claim 2, wherein said metal hydride is introduced into said hollow body at a location which is as far away as possible from said outlet opening.

9. The method according to claim 2, additionally comprising the step of separately heating said metal hydride towards the end of said flushing phase to a temperature which is higher than said temperature at which said hydrogen has been previously released.

10. The method according to claim 3, additionally comprising the step of separately heating said metal hydride towards the end of said flushing phase to a temperature which is higher than said temperature at which said hydrogen has been previously released.

11. The method according to claim 2, additionally comprising the step of operatively connecting a vacuum pump to said hollow body and assisting the removal of a part of said gaseous atmosphere contained in said hollow body at least after said heating of said metal hydride.

12. The method according to claim 3, additionally comprising the step of operatively connecting a vacuum pump to said hollow body and assisting the removal of a part of said gaseous atmosphere contained in said hollow body at least after said heating of said metal hydride.

13. The method according to claim 4, additionally comprising the step of operatively connecting a vacuum pump to said hollow body and assisting the removal of a part of said gaseous atmosphere contained in said hollow body at least after said heating of said metal hydride.

14. The method according to claim 2, wherein during said flushing phase said outlet opening is at the lowest level with respect to the remainder of said hollow body.

15. The method according to claim 3, wherein during said flushing phase said outlet opening is at the lowest level with respect to the remainder of said hollow body.

16. The method according to claim 4, wherein during said flushing phase said outlet opening is at the lowest level with respect to the remainder of said hollow body.

17. The method according to claim 5, wherein during said flushing phase said outlet opening is at the lowest level with respect to the remainder of said hollow body.

18. The method accordance to claim 2, whereby the quantity of said metal hydride introduced into said volume is limited to taking up less than about 3% of said evacuation volume.

19. The method accordance to claim 3, whereby the quantity of said metal hydride introduced into said volume is limited to taking up less than about 3% of said evacuation volume.

20. The method accordance to claim 4, whereby the quantity of said metal hydride introduced into said volume is limited to taking up less than about 3% of said evacuation volume.

21. The method accordance to claim 5, whereby the quantity of said metal hydride introduced into said volume is limited to taking up less than about 3% of said evacuation volume.

22. The method accordance to claim 6, whereby the quantity of said metal hydride introduced into said volume is limited to taking up less than about 3% of said evacuation volume.

* * * * *